US005623923A

United States Patent [19]

Bertheau et al.

[11] Patent Number: 5,623,923

[45] Date of Patent: Apr. 29, 1997

[54] RESPIRATORY EQUIPMENT WITH COMFORT ADJUSTMENT

[75] Inventors: Fernand Bertheau, Elancourt; Philippe Thomas, Montfort l'Amaury, both of France

[73] Assignee: Intertechnique, Plaisir, France

[21] Appl. No.: 471,221

[22] Filed: Jun. 6, 1995

Related U.S. Application Data

[63] Continuation-in-part of Ser. No. 257,271, Jun. 9, 1994, Pat. No. 5,504,147.

[30] Foreign Application Priority Data

Sep. 6, 1993 [FR] France ..... 93 06930

[51] Int. Cl.[6] ..... A62B 7/14

[52] U.S. Cl. ..... 128/207.11; 128/201.22; 128/206.27; 128/206.26; 2/6.1

[58] Field of Search ..... 128/201.22, 201.23, 128/201.24, 206.26, 207.11, 206.24, 206.27; 2/9, 6.1, 6.2, 413, 422, 424

[56] References Cited

U.S. PATENT DOCUMENTS

| | | | |
|---|---|---|---|
| 2,287,939 | 6/1942 | Kraft | 128/30 |
| 2,449,548 | 9/1948 | Burns | 128/202.11 |
| 3,599,636 | 8/1971 | Gutman et al. | 128/146.7 |
| 3,672,384 | 6/1972 | Hellguist | 128/202.11 |
| 3,792,702 | 2/1974 | Delest | 128/146.7 |
| 4,437,462 | 3/1984 | Piljay et al. | 128/207.11 |
| 4,664,108 | 5/1987 | Ansite | 128/202.26 |
| 5,036,846 | 8/1991 | Aulgur et al. | 128/207.11 |

FOREIGN PATENT DOCUMENTS

| | | |
|---|---|---|
| 288391 | 10/1988 | European Pat. Off. . |
| 2516391 | 5/1983 | France . |

OTHER PUBLICATIONS

Eros Magic Quick Donning Mask (4 pages) Scott Co.
Eros Quick Donning Mask (2 pages) Scott Co.

*Primary Examiner*—V. Millin
*Assistant Examiner*—William J. Deane, Jr.
*Attorney, Agent, or Firm*—Larson and Taylor

[57] ABSTRACT

A respiratory mask adapted to be fit against the face of a user is provided with a demand regulator connectable to a pressurized respiratory gas source. An extensible harness, having end portions connected to said mask, includes an inflatable element. A manually actuatable valve delivers pressurized respiratory gas from the source to the inflatable element to extend the harness when actuated and reduces the pressure in said inflatable element to retract said harness and to cause the mask to engage the face of the wearer when released. A sensor delivers an information representative of a force with which said mask engages the face to a valve for automatic control of exhaust of pressurized gas to atmosphere and admission of pressurized gas from the source, upon release of the manually actuatable valve to adjust the reduced pressure and to maintain the force at a value which is lower than the force exerted when the inflatable element is at an ambient pressure.

4 Claims, 4 Drawing Sheets

FIG.4.
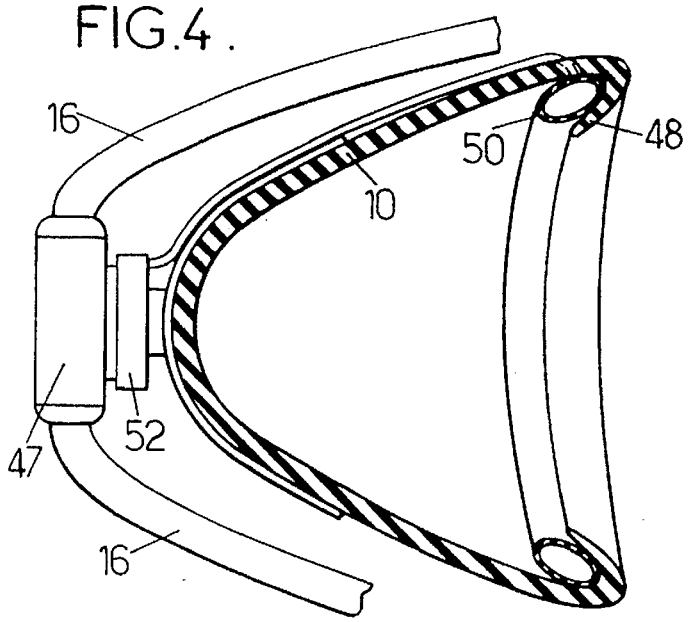
FIG.10.
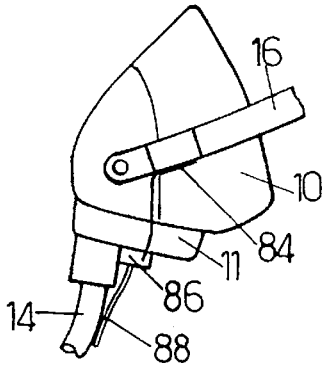
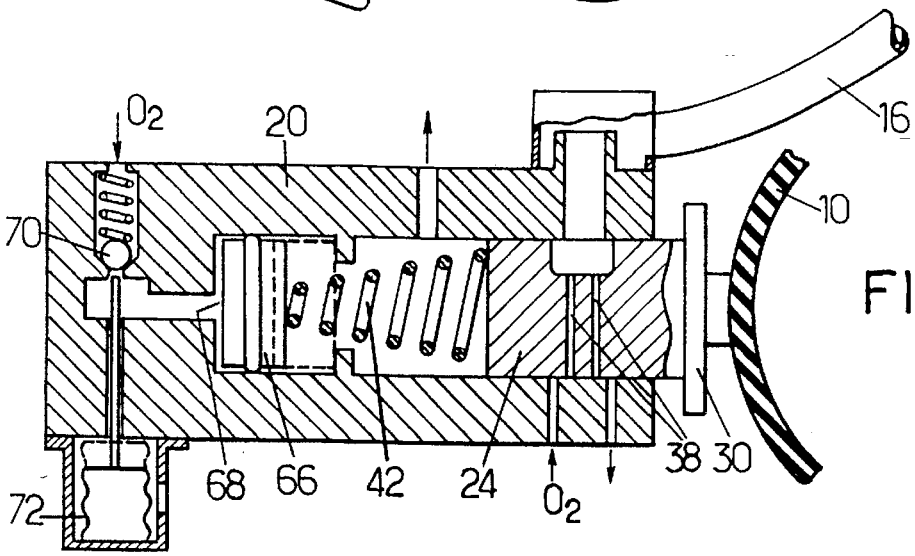
FIG.6.
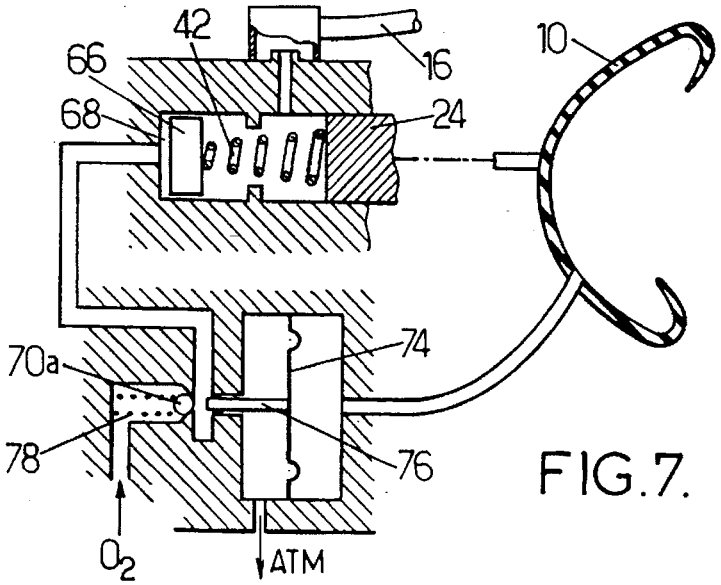
FIG.7.

RESPIRATORY EQUIPMENT WITH COMFORT ADJUSTMENT

CROSS REFERENCES TO RELATED APPL'NS

This is a Continuation in Part of application Ser. No. 08/257,271 filed Jun. 9, 1994 (Bertheau) now U.S. Pat. No. 5,504,147.

BACKGROUND OF THE INVENTION

The invention relates to head respiratory equipments of the type comprising a breathing mask, a head harness connected to the mask for quick donning onto the head of a user, and sometimes goggles for protection against smoke.

Quick donning harnesses for breathing masks are known which have a stretchable strap whose ends are connected to the mask, including an element which is inflatable with pressurized gas to stretch the strap to a size sufficient for enabling the user to place the strap over his head and which have manually controlled means enabling to deliver pressurized gas to the element to stretch it and to vent the element for causing the strap, due to the inherent resiliency thereof, to contact the head and to maintain the mask. The pressurized gas is typically oxygen which also feeds a demand regulator with air dilution carried by the mask.

Passenger and business air planes fly at increasingly higher altitudes. Beyond 40,000 feet (about 12,200 meters), the mask user should be immediately provided with pressurized breathable gas upon cabin depressurization. For avoiding gas leaks between the face cover and skin, the harness must then exert a high tension. When the flight conditions are such that the regulations require that the pilot or either pilot wears the mask at all times, such continuous use causes tiredness and discomfort. In addition, since the mask should be usable by all pilots, harnesses are constructed to achieve air tightness of the mask for the smallest head size and the tension forces are still more important on large size heads.

In an attempt to solve the problem, harnesses have been proposed which have means for maintaining, in the inflatable element, an intermediate pressure, which is called a comfort pressure. For instance, European No. 0,288,391 discloses a harness which, in a particular embodiment, further comprises an aneroid valve which automatically causes complete venting of the inflatable element and consequently a tight application of the mask onto the face, without user's manipulation, upon depressurization. U.S. Pat. No. 5,036,846 also discloses a harness having an inflatable element in which a residual intermediate comfort pressure may be maintained.

The harnesses described in both documents have a shortcoming. They require manual adjustment of the residual pressure in the harness and that pressure varies in dependence of the size of the head of the user for a same application force.

In addition, leaks (caused for instance by porosity of the inflatable element and/or by a lack of air tightness of the valves) frequently cause a progressive decrease of the pressure in the inflatable element and consequently a progressive increase of the force which applies the mask on the face, which requires a periodical re-inflation of the harness by the user for comfort.

SUMMARY OF THE INVENTION

An object of the present invention is to provide an equipment having a quick donning harness which requires, for use, a number of manipulations which is lesser than those previously known and which additionally renders unnecessary manipulations for maintaining the application force at a substantially constant value (which may possibly be adjustable); an other object is to provide a good compromise between comfort, safety and simplicity of use.

For that purpose, there is provided a head respiratory equipment comprising: a respiratory mask adapted to be fit against the face of a user and provided with a demand regulator with air dilution, connectable to a pressurized respiratory gas source; an extensible harness having end portions connected to said mask and including an element inflatable by the respiratory gas for being stretched up to a sufficient size for enabling the user to done it over the head, and manually controlled means for delivering said pressurized respiratory gas into the inflatable element for stretching it and to decrease the pressure in said element for enabling the harness to contact the head and forcibly apply the mask onto the face of the user. The equipment further comprises means for automatically admitting pressurized gas into a component of the harness, from the respiratory gas source and exhausting pressurized gas from said component to atmosphere, controlled by sensor means responsive to a tension force exerted by said harness, whereby a substantially constant force applying the mask onto the face is maintained, at least at as long as ambient pressure remains higher than a threshold, which may possibly be rendered adjustable.

The term "harness" should be construed broadly; it should particularly be understood as covering not only those products whose inflatable element consists of a tubular strap, but also equivalent products, such as those which comprise pneumatic jacks connected to a ring for abutment against the back of the head.

Typically, the component will consist of the inflatable element itself. However, the component may be an addtional element, such as an inflatable ring along the edge of the mask or an inflatable cushion located between the inflatable element (which is then arranged for only having a fully inflated and a fully depleted condition) and the back of the head. The last solution is however less advantageous, as regards complexity and efficiency.

When the equipement is for use in a plane which may reach an altitude higher than 40,000 feet (12,200 m), it is associated with a regulator which is able to deliver pressurized oxygen beyond 40,000 feet. The pressure differential between the inner volume and the outer of the mask biases the mask away from the face and should be balanced by an increase of the force which applies the mask on the face, for avoiding or at least limit leaks. In that case, a solution consists in controlling the inflatable component of the harness for exerting a constant force at all times. But then the force should be sufficiently high for being sufficient if depressurization occurs at a very high altitude. Comfort is consequently quite reduced at a lower altitude.

In that particular case, it is of advantage to design the inlet and exhaust means for them to adjust the pressure in the inflatable harness component at such a value that the force which forces the mask onto the face increases as the cockpit altitude increases, at least beyond a predetermined value of the altitude; alternatively, the inlet and exhaust means may be designed for automatically applying a maximum force if depressurization occurs. That result may be obtained by providing an aneroid capsule or bellows in addition to or in substitution for the resilient means.

The invention will be better understood from the following description of particular embodiments, given by way of examples. The description refers to the accompanying drawings.

BRIEF DESCRIPTION OF THE DRAWINGS

FIG. 4 is a schematic representation of a modified embodiment;

FIGS. 6 and 7, similar to FIGS. 3 and 4, illustrate still other embodiments, which provide a forced application of the mask onto the face if depressurization occurs at a high altitude;

FIG. 10 illustrates an arrangement having a sensor at the entrance of the strap.

DETAILED DESCRIPTION OF EMBODIMENTS

Figure 1:
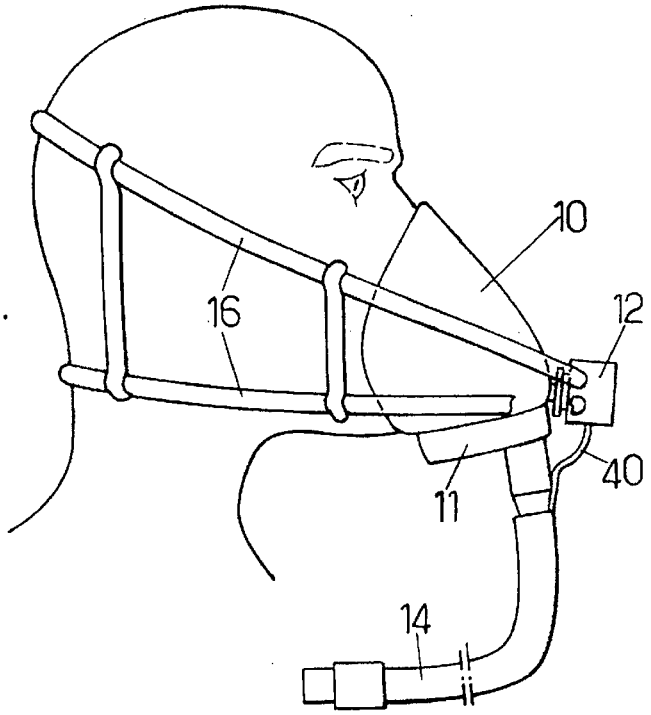
FIG. 1 is an elevational view indicating the outer aspect of a protection equipment according to an embodiment of the invention.

Referring to FIG. 1, a respiratory equipment, having a general construction which is known, is shown in conditions of use. The respiratory equipment comprises a mask having an oro-nasal face cover 10 (which may be arranged for receiving goggles for protection against smoke), secured to a demand regulator 11, and a harness for applying the mask onto the face. The ends of the harness are connected to a rigid connection block 12 of the mask.

The connection block is provided with a nozzle for receiving a flexible tube for connection with a supply of pressurized breathable gas (typically pressurized oxygen). As shown, the harness has two straps 16 each consisting of an inner tube of resilient material accommodated in a non-extensible sheath which limits the degree of lengthening of the inner tube. The length of the inflatable inner tubes at rest is such that they can apply the face cover onto the face with a force which exceeds the force necessary for providing a required air tightness, even when the mask receives a maximum respiratory overpressure.

The arrangement which has just been described is well known. A description may for instance be found in European Patent No. 0,288,391. Other harness constructions are however possible. For instance they may use pneumatic jacks and/or they may have a single strap.

Figure 2:
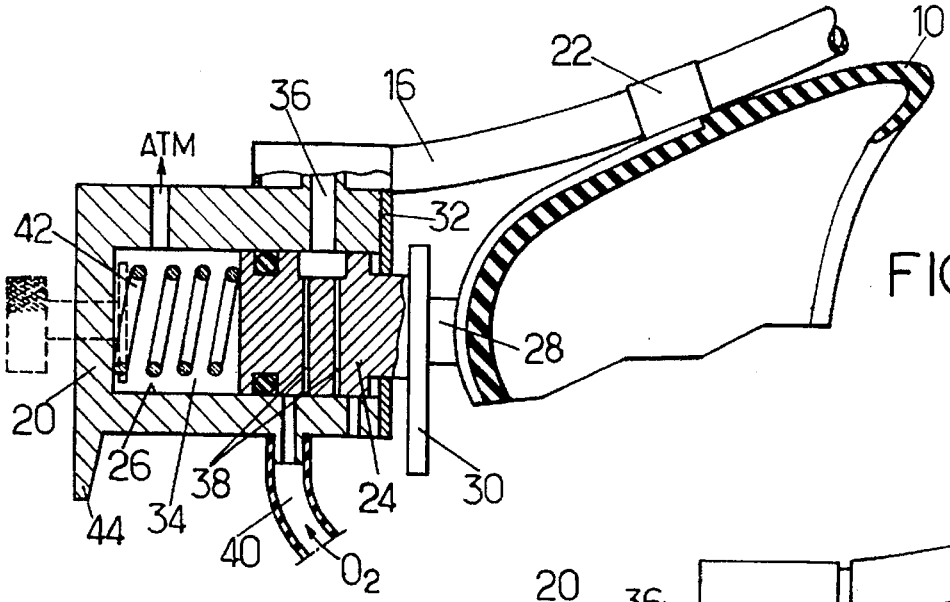
FIGS. 2 and 3 are schematic representations of two particular embodiments of a sensor-inlet means unit suitable for use in an equipment of the type shown in FIG. 1.

In the embodiment shown in FIGS. 1 and 2, the harness is not directly secured onto the face cover. Its ends are secured on the housing 20 of a unit (which may be embodied in the connection block). The unit comprises means for sensing the force exerted by the harness and means for delivery of pressurized gas into the straps and exhaust gas from the straps.

The two ends of the strap 16 (or of each strap) of the harness are secured to the housing 20. The strap or each strap is typically slidably guided on the face cover 10 by guides 22 which define the direction along which a tractive force exerted by the harness is applied to the mask. A plunger 24 is accommodated in a blind bore 26 of the housing and has an extension in the form of a pushrod 28 fastened to the face cover 10. The range of sliding movement of housing 20 is defined, in one direction, by contact between an abutment flange 30 of the plunger 24 and the housing and, in the other direction, by abutment of a shoulder of the plunger 24 against an abutment washer 32 securely connected to the housing.

The bottom wall of the bore and the plunger 24 define a chamber 34 which is continuously connected to the ambient atmosphere. An outlet 36 opening into the strap or straps is formed in the wall of that part of the bore which slidably receives the plunger 24. Passages 38 formed in the plunger 24 connect the outlet 36 with a feed tubing 40 which receives pressurized gas and with atmosphere, respectively, when the housing 20 moves beyond a predetermined position to the right and beyond a predetermined position to the left, as shown in FIG. 2. When the plunger is in an intermediate position, as shown in FIG. 2, the outlet 36 is closed.

Resilient means, which comprise a spring 42 in the embodiment of FIG. 2, bias the housing 20 toward an abutment position (toward the left on FIG. 2), where it connects the outlet 36 to atmosphere and consequently completely scavenges the straps and causes the face cover to be applied with a maximum force. The straps exert on the housing 20 a force which biases it toward a position, with respect to the plunger, where gas passes from the feed tubing 40 to the straps through the outlet 36. By manually moving the housing 20 (to the right on FIG. 2), for instance by squeezing a finger grip 44 and the abutment flange 30 of the plunger, the mask user may cause complete inflation of the straps and may cause the harness to take a shape enabling to don it easily.

The operation of the equipment immediately appears from the foregoing description. When the harness has been placed on the head and the finger grip has been released, the spring 42 moves the housing into a position where it causes programme depletion of the harness. As the pressure in the harness decreases, the harness exerts an increasing force, directed toward the face cover, on the housing. The housing moves back to the outlet closing position where it is shown in FIG. 2, where the two forces are mutually balanced.

If there are leaks, due for instance to porosity of the inflatable element of the straps, the housing progressively moves until it comes to a position where an additional volume of gas is delivered to the strap(s) and decreases the force exerted by the harness.

The so-regulated force may be rendered manually adjustable, for instance by providing a knurled screw (in dashed lines on FIG. 2) across the bottom wall of the housing; the screw constitutes an abutment for spring 42.

Figure 3:
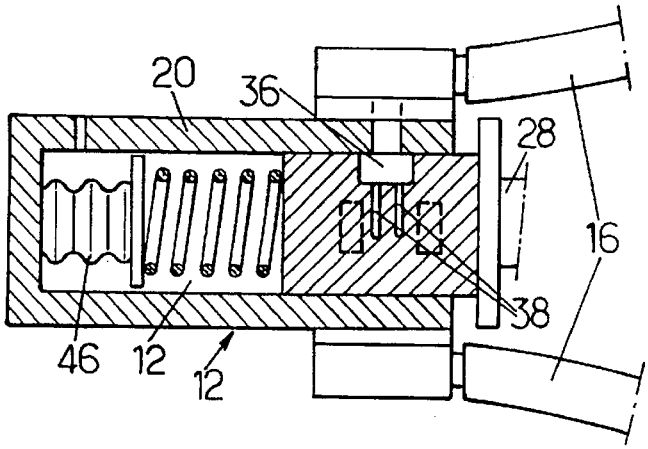

In the modified embodiment illustrated in FIG. 3 (where the elements corresponding to those of FIG. 2 are designated by the same reference numerals) the spring 42 has an abutting connection with aneroid bellows 46. The bellows expand when the ambient pressure decreases. For instance, it significantly expands if there is depressurization at a high altitude and then causes that amount of increase in the application force of the harness and mask which is necessary for resisting the altitude depending overpressure which prevails in the mask.

An additional possible function of the aneroid bellows is to enable to accept a very low value of the force exerted by the harness at a low cockpit altitude. Then there is a maximum degree of comfort for the long time use of the mask, as required by regulations when the flight altitude exceeds a predetermined value.

In the modified embodiment shown in FIG. 4, the straps 16 are connected to a valve 47 which, when not energized, completely depletes the straps and, when energized, connects them to the pressurized gas feed tube. The inflatable element may consequently be of a type currently used at the present time and described in U.S. Pat. No. 3,599,636 for instance. On the other hand, the face cover additionally comprises, in the fold of the sealing lip 48, an inflatable ring 50 in which the pressure is controlled by a unit 52. That unit 52 comprises a force sensor and inflating means and may be of the type shown in FIG. 2, however with inverted operation, since a pressure increase in the inflatable ring 50 results in an increase of the application force, not in a decrease.

Figure 5:
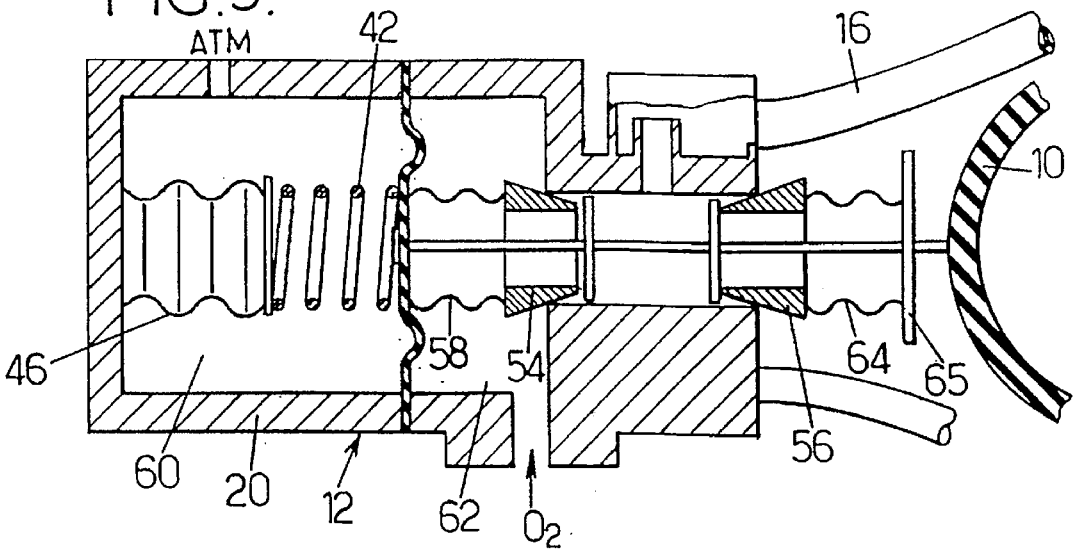
FIG. 5, similar to FIG. 3, illustrates another possible construction of the sensor-inlet means unit.

In the modified embodiment shown in FIG. 5, where the elements corresponding to those of FIG. 2 are again designated by the same reference numerals, the force sensor-inlet means unit has aneroid bellows which constitute an abutment for the spring 42 whose force determines the degree of application of the mask on the face. However, the plunger of FIG. 5 is replaced with a set of two valve members 54 and 56. The inlet valve member 54 is connected by flexible bellows 58 to a diaphragm which separates a chamber 60 (where the ambient pressure prevails) from a chamber 62 which receives the pressurized breathing gas. The exhaust valve member 56 is connected by flexible bellows 64 to an end plate 65 fixed to a rod connecting the diaphragm and the face cover 10.

The rod and two cross plates carried by the rod constitute a unit for control of the valve members. The plates alternatively open the valve members or leave them free to contact their seats, depending upon the position of the control unit.

Referring to FIG. 6, another embodiment automatically increases the harness force, upon depressurization, by an amount sufficient for decreasing the leaks, although depressurization causes delivery of pressurized oxygen to the mask.

Then the device comprises, in addition to the elements already shown in FIG. 1, a piston 66 which constitutes a movable abutment for spring 42. The piston 66 constitutes a movable wall of a chamber 68 formed in the housing. The chamber 68 communicates with the ambient atmosphere via a throttled path. A valve 70 (a ball valve in the illustrated example) separates chamber 68 from the pressurized oxygen supply. Aneroid bellows 72, which may be the aneroid bellows of a demand regulator of the mask, open valve 70 if there is depressurization.

When the ambient pressure is higher than a predetermined threshold, the components of the device are in the relative arrangement shown in full lines on FIG. 6 (comfort position). The ball valve 70 is closed. If depressurization of the cockpit occurs, the aneroid bellows expand and open ball valve 70. Then the piston 66 moves up to the abutment position shown in dashed lines on FIG. 6. The force exerted by spring 42 increases and moves the plunger 24 which scavenges the harness.

FIG. 7 illustrates still another embodiment which, as the embodiment of FIG. 6, automatically causes scavenging and tightening of the harness if there is feeding of the mask with pressurized oxygen, responsive to depressurization. The ball valve **70*a* which communicates the chamber 68 with the pressurized oxygen supply is opened responsive to an overpressure in the face cover of mask 10. In FIG. 7, means for forcibly opening the ball valve comprise a deformable diaphragm 74 (which may be replaced by a piston) subjected to the pressure which prevails in the mask, fixed to a needle 76 which lifts the ball of valve 70*a* from its seat upon depressurization and delivery of gas to the mask under a pressure such the pressure differential between the mask and the ambient atmosphere exceeds a threshold which is adjusted by the prestress of a spring 78** which forces the valve into closed condition.

Aneroid bellows for scavenging the harness upon depressurization may also be added to the assembly illustrated in FIG. 5.

Figure 8:
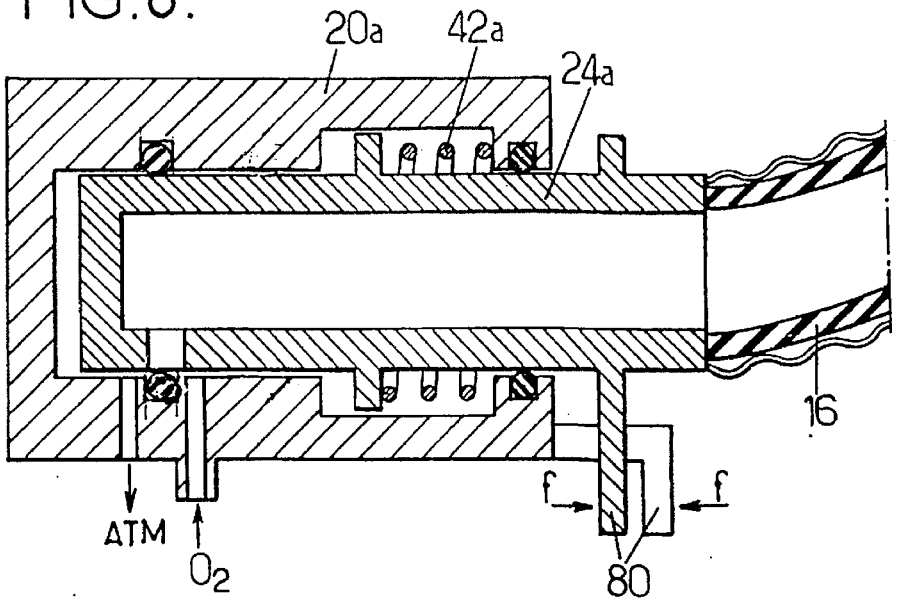
FIG. 8 is a schematic representation of a head equipment in which the sensor-inlet means unit is located at the entrance of at least one strap of a harness.

In the embodiments illustrated in FIGS. 2, 3, 5 and 6, the sensor-inlet means unit is located between the face cover 10 and the harness. The unit may as well be located between the connection block 12 and one end (or each end) of the harness. Such an arrangement is illustrated in FIG. 8. The end portion of strap 16 is fastened to a plunger **24*a* which is slidable in a housing 20*a* fast with the connection block of a mask. A spring 42*a* biases the plunger toward a position where it connects strap 16** to atmosphere, while the tractive force exerted by the strap tends to connect the latter to the respiratory gas supply.

By manually moving projections 80 of the housing and plunger toward each other, as indicated by arrows f, the mask user may completely inflate the harness for donning or removing the mask.

Numerous modifications of the embodiment of FIG. 8, (as well as of preceding ones) are possible. For instance, the embodiment of FIG. 8 may include, as the embodiments of FIGS. 6 and 7, aneroid bellows for automatically scavenging the harness responsive to depressurization of the cockpit and/or admission of overpressurized gas to the mask.

When the harness has two straps, the two straps may each have a separate device, for maintaining an appropriate distribution of the tightening efforts of the straps in all conditions of use and for stable positioning of the mask on the face.

The device may further be provided with means for modifying at will the value of the overpressure in the mask for which there is complete scavenging of the harness. For instance, the capsule or bellows 46 or 72 (FIGS. 5 and 6) may be carried by the end of an adjusting screw rather than in abutment against a fixed element.

Figure 9:
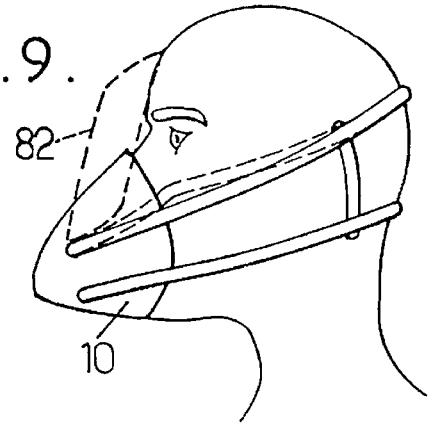
FIG. 9 is a schematic representation of a device whose mask may be provided with goggles, with a modification of the distribution of forces when the goggles are donned.

The conditions in which the mask must be donned frequently render advisable simultaneous use of goggles. A same mask may be designed for being used alone or with goggles 82 (shown in dashed lines on FIG. 9) which are rigidly securable to the mask. The edge of the goggles should be applied onto the face, for instance for protecting the eyes against smoke.

For obtaining a sufficient application force, each strap may be provided With a separate device and the upper strap may be provided with adjustment means for increasing the force applied by the upper strap when the goggles are donned. Another possibility consists in providing a mask with hooks for modifying the point of application of the effort exerted by the upper strap (or the single strap) when the goggles are donned, as indicated in dashed lines on FIG. 9.

In all embodiments which have been described up to now, the device for adjusting the tensional force is purely pneumatic. It is also possible to use an electropneumatical device, comprising a force sensor consisting of a transducer having an electric output and electrically controlled means for inserting delivery of pressurized gas and for maintaining the pressure in the harness at a value such that the tensional force exerted by the harness has a value which is constant or which varies responsive to the cockpit "altitude" according to a predetermined law. FIG. 10 illustrates such a device. A sensor 84, consisting of a transducer having an electric output, is located at the connection of the harness with the mask. It delivers an output signal to a control component 86 which also receives an electric supply 88. The control component 86 comprises an electrically controlled valve for adjusting the pressure in the harness. The device may further include a sensor for measuring the ambient pressure and/or a sensor for measuring the pressure in the mask, which causes complete scavenging of the harness responsive to depressurization.

Figure 11:
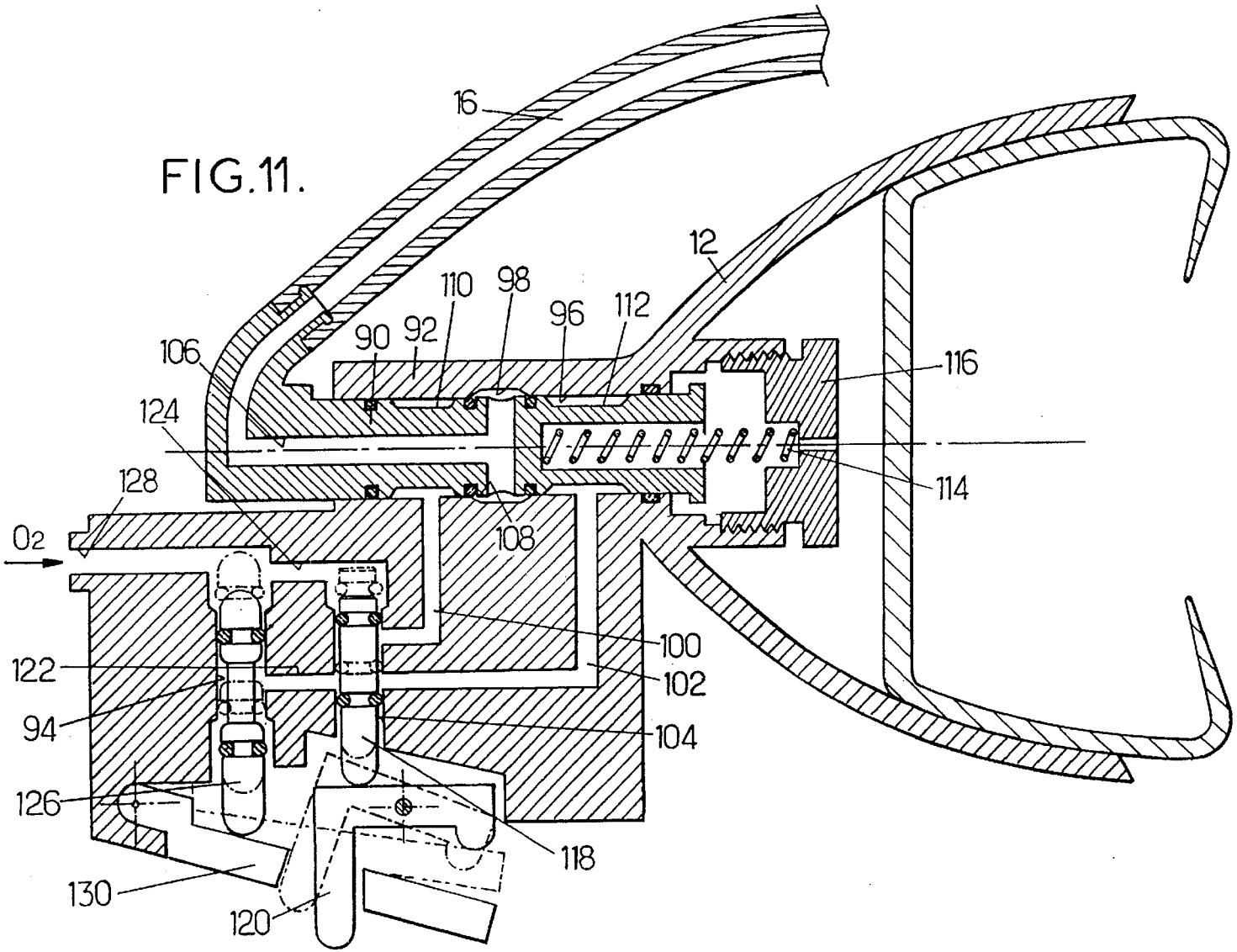
FIG. 11, similar to FIG. 2, is a representation of still another embodiment.

Referring to FIG. 11, where the elements corresponding to those of FIG. 2 are designated by the same reference numbers, the two ends of each inflatable strap 16 are connected to a plunger 90. Only one end has been shown for clarity. A connecting block 12 of the face cover is securely connected to or integral with a housing 92. The housing is formed of a plurality of parts which are mutually connected by fastening means (not shown), such as screws.

A force-regulating valve is received in housing 92. It comprises a bore 96 formed in the housing, in an axial direction of the mask. A counterbore 98 is formed in a mid-portion of the bore 96. Passages 100 and 102 communicate the bore 96 with another bore 104 formed in the housing for receiving a mode selection valve which will be described thereafter. The passages 100 and 102 open on different sides of the counterbore 98 and at a distance thereof.

The valve plunger 90 is slidably received in bore 96. Passage means 106 formed in the plunger 90 open into the straps and in a median cylindrical surface 108 of the plunger. Two circonferential receses are formed each on one side of surface 108.

Resilient means, such as a spring 114 are provided for exerting on the plunger an adjustable force tending to move it away from the mask. As illustrated, the resilient means include a spring 114 located between the bottom of a blind bore formed in plunger 90 and a threaded plug 116 formed with a venting hole. As will be seen later, the degree of tightening of the plug determines the force which will be exerted by the harness in the comfort mode of operation.

Sliding seals, typically O-rings, are provided on the plunger and/or housing at such locations that they separate the counterbore 98 from passages 100 and 102 when the plunger 90 is an equilibrium position in which the force exerted by the spring 114 and the force exerted by the inflatable straps 16 are balanced.

If, due to unbalance, the plunger moves to the left on the Figure by a sufficient extent, then the counterbore 98 and consequently the straps 16 will communicate with passage 100. If on the other hand, the plunger moves to the right by a sufficient extent, then the counterbore and straps will communicate with passage 102.

The comfort mode selection valve comprises a valve member 118 which is illustrated in full lines in a no-comfort position and in interrupted lines in the position for comfort. A finger-actuated lever 120 is movable between a rest position (in full line) and an actuated position (in interrupted line) where it maintains the valve member 118 in the comfort mode. A mechanical latch (not shown), possibly released by a second action on the hand lever, retains the lever in the actuated position.

The comfort mode selection valve, when in rest position, communicates both passages 100 and 102 with the first port 122. When in actuated condition, it communicates passage 100 with another port 124 while maintaining a communication between passage 102 and port 122.

A second valve member 126, similar to valve member 118, is slidably received in another bore 94 of the housing and constitutes an inflation control valve. An end of the bore communicates with a pressurized oxygen inlet 128 while the other end of the bore opens to atmosphere. A finger-actuated lever 130 communicates port 124 to the oxygen inlet and port 122 to atmosphere when in the rest position indicated in full lines. The oxygen pressure tends to bring back the inflation control valve to that condition. If on the other hand, the second valve member 122 is forced by lever 130 to the position indicated in interrupted line, then both ports 122 and 124 communicate with the pressurized oxygen supply.

Again, the apparatus may be provided with an aneroid system for full deflation of the harness upon depressurization. It may be associated with a conventional demand regulator.

Operation is as follows. When the levers 120 and 130 are in the positions illustrated in full line, then the inflatable straps are fully deflated. Passages 100 and 102 are at the ambient pressure. Any communication between the counterbore 98 and one of the passages will establish atmospheric pressure in the inflatable strap. In final condition, the spring 114 will maintain the plunger 90 in its leftmost position, which may for instance be defined by abutment of a shoulder of the plunger on the housing.

For fast doning without comfort, the user presses down lever 130. Then both passages 100 and 102 are connected to the pressurized oxygen supply. Since plunger 90 is initially in its leftmost position, counterbore 98 receives pressurized oxygen and the straps 16 become fully inflated for fast doning. Release of lever 130 will cause deflation.

If on the other hand, lever 120 is pressed down and locked to maintain valve member 118 in its actuated position, then the plunger 90 will move until it is again in the position shown on FIG. 11, with the force due to the strap balancing the force of spring 114.

We claim:

1. Head respiratory equipment comprising:

a respiratory mask adapted to be fit against the face of a user and provided with a demand regulator with air dilution, connectable to a pressurized respiratory gas source;

an extensible harness having end portions connected to said mask and including an element 16 inflatable by the respiratory gas for being stretched up to a sufficient size for enabling the user to don it over the head, manually controlled means for delivering said pressurized respiratory gas from said source into the inflatable element for stretching it and to allow the pressure to decrease in said element for enabling the harness to contact the head and forcibly apply the mask onto the face of the user, and pressure control means for automatically admitting pressurized gas into a compound of the harness, from the respiratory gas source, and for exhausting pressurized gas from said compound to atmosphere, comprising:

a housing securely connected to said mask, formed with a bore;

a plunger slidably received in said bore and secured to said end portions; and comfort mask selection means comprising a valve member manually movable between a comfort position where it is apt to communicate a first passage opening into said bore with atmosphere and it communicates a second passage opening into said bore at a distance from said first passage with an inlet connectable to said source and another position where it is apt to communicate said first and second passages simultaneously to atmosphere;

wherein said plunger is formed with a third passage opning into said resilient element and is arranged to separate said third passage from said first and second passages when in a mid-position in said bore, to communicate said third passage and said first passage when said plunger is moved along said bore from said mid-position in a predetermined direction past a predetermined position and for communicating said second and third passages when said plunger is moved in an opposite direction past another predetermined position.

2. Equipment according to claim 1, wherein said resilient element includes an inner tube of resilient material accomodated in a non-stretchable sheath, said resilient element having a resiliency which tends to move said plunger in said predetermined direction.

3. Equipment according to claim 1, wherein said valve member of said comfort mask selection means is movable in and along a bore toward said comfort position by a finger-actuatable lever against a pressure force exerted by said respiratory gas from said source.

4. Equipment according to claim 3, having:

a further passage opening into said bore and having a same longitudinal position as an opening of said first passage into said bore, an additional bore having an end opening to atmosphere and an opposite end communicating with said inlet, said further passage communicating with an intermediate point of said additional bore, and a second valve member slidably received in said additional bore, movable by a second finger-actuated lever against a pressure force due to said respiratory gas, from a position in which it communicates said further passage with atmosphere into a position where it communicates said further passage with said inlet.

* * * * *